US010418025B2

(12) United States Patent
Shechtman et al.

(10) Patent No.: US 10,418,025 B2
(45) Date of Patent: Sep. 17, 2019

(54) SYSTEM AND METHOD FOR GENERATING EXPRESSIVE PROSODY FOR SPEECH SYNTHESIS

(71) Applicant: International Business Machines Corporation, Armonk, NY (US)

(72) Inventors: Slava Shechtman, Haifa (IL); Zvi Kons, Yoqneam Ilit (IL)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/832,793

(22) Filed: Dec. 6, 2017

(65) Prior Publication Data

US 2019/0172443 A1 Jun. 6, 2019

(51) Int. Cl.

| | |
|---|---|
| ***G10L 13/10*** | (2013.01) |
| ***G10L 25/30*** | (2013.01) |
| ***G10L 13/027*** | (2013.01) |
| ***G10L 13/033*** | (2013.01) |
| ***G10L 13/047*** | (2013.01) |

(52) U.S. Cl.

CPC ..... *G10L 13/10* (2013.01); *G10L 13/027* (2013.01); *G10L 13/047* (2013.01); *G10L 13/033* (2013.01); *G10L 25/30* (2013.01)

(58) Field of Classification Search

CPC ..... G10L 13/033; G10L 13/08; G10L 13/10; G10L 25/30; G10L 13/027

USPC ..... 704/259–261

See application file for complete search history.

(56) References Cited

U.S. PATENT DOCUMENTS

2008/0235025 A1* 9/2008 Murase ..... G10L 13/033 704/260
2009/0157409 A1* 6/2009 Lifu ..... G10L 13/08 704/260
2009/0234652 A1* 9/2009 Kato ..... G10L 13/033 704/260

(Continued)

OTHER PUBLICATIONS

Beller, Grégory. "Expresso: Transformation of expressivity in speech." Speech Prosody 2010—Fifth International Conference. May 2010, pp. 1-4. (Year: 2010).*

(Continued)

*Primary Examiner* — James S Wozniak
(74) *Attorney, Agent, or Firm* — G.E Ehrlich

(57) ABSTRACT

A method for producing speech comprises: accessing an expressive prosody model, wherein the model is generated by: receiving a plurality of non-neutral prosody vector sequences, each vector associated with one of a plurality of time-instances; receiving a plurality of expression labels, each having a time-instance selected from a plurality of non-neutral time-instances of the plurality of time-instances; producing a plurality of neutral prosody vector sequences equivalent to the plurality of non-neutral sequences by applying a linear combination of a plurality of statistical measures to a plurality of sub-sequences selected according to an identified proximity test applied to a plurality of neutral time-instances of the plurality of time-instances; and training at least one machine learning module using the plurality of non-neutral sequences and the plurality of neutral sequences to produce an expressive prosodic model; and using the model within a Text-To-Speech-System to produce an audio waveform from an input text.

19 Claims, 9 Drawing Sheets

(56) References Cited

U.S. PATENT DOCUMENTS

| | | | | |
|---|---|---|---|---|
| 2014/0052446 | A1* | 2/2014 | Mori | G10L 13/10 704/260 |
| 2014/0195242 | A1 | 7/2014 | Chen | |
| 2017/0110110 | A1 | 4/2017 | Pollet | |
| 2017/0309271 | A1* | 10/2017 | Chiang | G10L 13/0335 |
| 2017/0365277 | A1* | 12/2017 | Park | G10L 25/63 |

OTHER PUBLICATIONS

Chen, Langzhou, et al. "Speaker and expression factorization for audiobook data: Expressiveness and transplantation." IEEE Transactions on Audio, Speech, and Language Processing 23.4, Dec. 2014, pp. 1-15. (Year: 2014).*

Gamal, Doaa, et al. "Emotion conversion for expressive Arabic text to speech." Computer Systems and Applications (AICCSA), 2014 IEEE/ACS 11th International Conference on. IEEE, Nov. 2014, pp. 342-348. (Year: 2014).*

Inanoglu, Zeynep, et al. "Data-driven emotion conversion in spoken English." Speech Communication 51.3, Mar. 2009, pp. 268-283. (Year: 2009).*

Tao, Jianhua, et al. "Prosody conversion from neutral speech to emotional speech." IEEE Transactions on Audio, Speech, and Language Processing 14.4, Jul. 2006, pp. 1145-1154. (Year: 2006).*

Turk, Oytun, et al. "Evaluation of expressive speech synthesis with voice conversion and copy resynthesis techniques." IEEE Transactions on Audio, Speech, and Language Processing 18.5, Jul. 2010, pp. 965-973. (Year: 2010).*

Veaux, Christophe, et al. "Intonation conversion from neutral to expressive speech." Twelfth Annual Conference of the International Speech Communication Association. Aug. 2011, pp. 2765-2768. (Year: 2011).*

Yang, Hongwu, et al. "Modeling the acoustic correlates of expressive elements in text genres for expressive text-to-speech synthesis." Ninth International Conference on Spoken Language Processing. Sep. 2006, pp. 1-4. (Year: 2006).*

Chandak et al., "Text to Speech Synthesis with Prosody feature: Implementation of Emotion in Speech Output using Forward Parsing", International Journal of Computer Science and Security, 2010, pp. 352-360, vol. 4, Issue 3.

Chandak et al., "Corpus Based Emotion Extraction to Implement Prosody Feature in Speech Synthesis Systems", International Journal of Computer and Electronics Research, 2012, pp. 67-75, vol. 1, Issue 2.

Pitrelli et al., "The IBM Expressive Text-to-Speech Synthesis System for American English", IEEE Transactions on Audio, Speech, and Language Processing, Jul. 2006, pp. 1099-1108, vol. 14, Issue 4.

Iida et al., "A speech synthesis system with emotion for assisting communication", 2000, Proceedings of the ISCA Workshop on Speech and Emotion, pp. 167-172.

Yu et al., "Word-level emphasis modelling in HMM-based speech synthesis", 2010 IEEE International Conference on Acoustics, Speech and Signal Processing, Mar. 2010, pp. 4238-4241.

* cited by examiner

SYSTEM AND METHOD FOR GENERATING EXPRESSIVE PROSODY FOR SPEECH SYNTHESIS

BACKGROUND

The present invention, in some embodiments thereof, relates to a system for speech synthesis and, more specifically, but not exclusively, to a system for speech synthesis from text.

Prosody refers to elements of speech that are not individual phonetic segments (vowels and consonants) but are properties of syllables as well as of larger units of speech or smaller (sub phonemic) units of speech. These elements contribute to linguistic functions such as intonation, tone, stress, and rhythm. Prosody may reflect various features of a speaker or an utterance: an emotional state of the speaker; a form of the utterance (statement, question, or command); presence of irony or sarcasm; emphasis, contrast, and focus; or other elements of language that may not be encoded by grammar or by choice of vocabulary. Prosody may be described in terms of auditory measures. Auditory measures are subjective impressions produced in the mind of a listener. Examples of auditory measures are a pitch of a voice, a length of a sound, a sound's loudness and a timbre. Another possible way to describe prosody is using terms of acoustic measures. Acoustic measures are physical properties of a sound wave that may be measured objectively. Examples of acoustic measures are a fundamental frequency, duration, an intensity level, and spectral characteristics of the sound wave.

Speech synthesis refers to artificial production of human speech. One of the challenges faced by a system for synthesizing speech, for example from text, is generation of natural sounding prosody. There are applications, for example Concept To Speech (CTS) applications, where it is desirable to convey non-linguistic cues, for example speaking styles, emotions, and word emphasis. An example of a CTS is a dialog generation application such as an automatic personal assistant. In some CTS applications the input is machine generated text or a machine generated message. A text to speech (TTS) system, for synthesizing speech from text, may receive as an input a textual input and produce a phonetic and semantic representation of the textual input comprising a plurality of textual feature vectors. The plurality of textual feature vectors may be delivered to a TTS backend comprising a waveform generator to convert into sound, producing a waveform of speech. In some TTS systems, target prosody is imposed on the speech waveform, before delivering the waveform to an audio device or to an audio file. Given a text and a set of labels marking one or more non-linguistic cues, the TTS system needs a way to render the prosodic contour of the synthesized speech in order to convey the emotional content.

Some systems apply machine learning to create a model for predicting expressive prosody from textual feature vectors. One possible method for creating a model is by learning a difference between a plurality of expressive recordings of a plurality of utterances to a plurality of equivalent parallel neutral (non-expressive) recordings of the plurality of utterances, dependent on the textual features.

SUMMARY

It is an object of the present invention to provide a system and method for speech synthesis and, more specifically, but not exclusively, to a system for speech synthesis from text.

In addition, it is an object of the present invention to provide a system and method for producing an expressive prosodic model for use within a system for speech synthesis.

The foregoing and other objects are achieved by the features of the independent claims. Further implementation forms are apparent from the dependent claims, the description and the figures.

According to a first aspect of the invention, a method for producing speech comprises: accessing an expressive prosody model, wherein the expressive prosody model is generated by: receiving a plurality of non-neutral target prosody vector sequences describing a plurality of reference voice samples of one or more reference speakers, each prosody vector associated with one of a plurality of time instances; receiving a plurality of reference textual features comprising a plurality of expression labels describing the plurality of reference voice samples, each label having a time instance selected from a plurality of non-neutral time instances selected from the plurality of time instances; producing a plurality of parallel neutral prosody vector sequences equivalent to the plurality of non-neutral target prosody vector sequences at the plurality of non-neutral time instances by applying a linear combination of a plurality of statistical measures computed using a plurality of sub-sequences of the plurality of target prosody vector sequences to the plurality of sub-sequences, where the plurality of sub-sequences is selected according to an identified proximity test applied to a plurality of neutral time instances identified in the plurality of time instances; and training at least one machine learning module using the plurality of non-neutral target prosody vector sequences and the plurality of parallel neutral prosody vector sequences to produce an expressive prosodic model; and using the expressive prosody model within a Text To Speech (TTS) system to produce an audio waveform from an input text.

According to a second aspect of the invention, system for producing speech comprises at least one hardware processor configured to: access an expressive prosody model, wherein the expressive prosody model is generated by: receiving a plurality of non-neutral target prosody vector sequences describing a plurality of reference voice samples of one or more reference speakers, each prosody vector associated with one of a plurality of time instances; receiving a plurality of reference textual features comprising a plurality of expression labels describing the plurality of reference voice samples, each label having a time instance selected from a plurality of non-neutral time instances selected from the plurality of time instances; producing a plurality of parallel neutral prosody vector sequences equivalent to the plurality of non-neutral target prosody vector sequences at the plurality of non-neutral time instances by applying a linear combination of a plurality of statistical measures computed using a plurality of sub-sequences of the plurality of target prosody vector sequences to the plurality of sub-sequences, where the plurality of sub-sequences is selected according to an identified proximity test applied to a plurality of neutral time instances identified in the plurality of time instances; and training at least one machine learning module using the plurality of non-neutral target prosody vector sequences and the plurality of parallel neutral prosody vector sequences to produce an expressive prosodic model; and using the expressive prosody model to produce an audio waveform from an input text.

According to a third aspect of the invention, system for producing an expressive prosodic model comprises at least one hardware processor configured to: receive a plurality of non-neutral target prosody vector sequences describing a plurality of reference voice samples of one or more reference speakers, each prosody vector associated with one of a plurality of time instances; receive a plurality of reference textual features comprising a plurality of expression labels describing the plurality of reference voice samples, each label having a time instance selected from a plurality of non-neutral time instances selected from the plurality of time instances; produce a plurality of parallel neutral prosody vector sequences equivalent to the plurality of non-neutral target prosody vector sequences at the plurality of non-neutral time instances by applying a linear combination of a plurality of statistical measures computed using a plurality of sub-sequences of the plurality of target prosody vector sequences to the plurality of sub-sequences, where the plurality of sub-sequences is selected according to an identified proximity test applied to a plurality of neutral time instances identified in the plurality of time instances; and train at least one machine learning module using the plurality of non-neutral target prosody vector sequences and the plurality of parallel neutral prosody vector sequences to produce an expressive prosodic mode.

With reference to the first and second aspects of the invention, in a first possible implementation of the present invention applying a linear combination of a plurality of statistical measures comprises: identifying a plurality of neutral time instances where the plurality of expression labels has a neutral label or no label, each of the plurality of neutral time instances being in an identified vicinity of at least one of the plurality of non-neutral time instances; producing a plurality of useful time instance sequences by augmenting each neutral time instance in the plurality of neutral time instances with at least some of the plurality of non-neutral time instances in the identified vicinity of the neutral time instance; producing the plurality of sub-sequences by producing for each time instance sequence of the useful time instance sequences a sub-sequence, comprising: selecting from one vector sequence of the plurality of target prosody vector sequences one or more vectors, each associated with a time instance in the time instance sequence; and associating the sub-sequence with the vector sequence and the at least some non-neutral time instance of the time instance sequence; applying a linear combination of a plurality of statistical measures computed using the plurality of sub-sequences to each of the plurality of sub-sequences to produce a plurality of approximate neutral prosody vectors associated with the at least some non-neutral time instances of the sub-sequences; and producing the plurality of parallel neutral prosody vector sequences by for each vector in the plurality of target prosody vector sequences, where the vector is associated with a time instance having an expression label in the plurality of expression labels selecting one of the plurality of approximate neutral prosody vectors associated with the time instance and the vector's target sequence, and otherwise selecting the vector. Selecting a plurality of sub-sequences according to a temporal proximity to a plurality of vectors having an expression label and applying a linear combination of statistical measures to the plurality of sub-sequences may counteract non-neutral characteristics of one or more of the prosody vectors. Optionally, the linear combination of a plurality of statistical measures applied to each sub-sequence comprises: computing a mean vector of all vectors in the sub-sequence;

multiplying the mean vector by an intensity control factor using component-wise multiplication to produce a first term; identifying an extreme vector by identifying a maximum vector or a minimum vector of all vectors in the sub-sequence; computing a complementary factor by subtracting the intensity control factor from 1; multiplying the extreme vector by the complementary factor using component-wise multiplication to produce a second term; and adding the first term to the second term. Optionally, the plurality of statistical measures comprises a plurality of vectors produced by computing a quantile function using the plurality of sub-sequences at a predefined plurality of points. Optionally, the predefined plurality of points consists of 0.05, 0.5, and 0.95.

With reference to the first and second aspects of the invention, in a second possible implementation of the present invention the plurality of non-neutral prosody vector sequences are normalized with the parallel neutral prosody vector sequences to produce a plurality of normalized non-neutral prosody vector sequences; and the at least one machine learning module is trained using the plurality of normalized non-neutral target prosody vector sequences and the plurality of textual features to produce the expressive prosodic model. Normalizing the plurality of non-neutral prosody vector sequences with the parallel neutral prosody vector sequences may reduce prosody prediction errors and speed up training of the machine learning module.

With reference to the first and second aspects of the invention, in a third possible implementation of the present invention the expressive prosody model is further generated by outputting the expressive prosodic model to a digital storage in a format that can be used to initialize another machine learning module. Initializing another machine learning module with an expressive prosodic model trained in the system may reduce time and computation resources needed to create another system for producing speech thus reducing costs of creating the other system.

With reference to the first and second aspects of the invention, in a fourth possible implementation of the present invention the audio waveform is produced for the input text using the expressive prosody model by: receiving the input text and a plurality of style labels associated with at least part of the input text; converting the input text into a plurality of textual feature vectors using conversion methods as known in the art; applying the expressive prosodic model to the plurality of textual feature vectors and the plurality of style labels to produce a plurality of expressive prosody vectors; and generating an audio waveform from the plurality of textual feature vectors and the plurality of expressive prosody vectors. Producing textual features from an input text and a plurality of style labels may be a means of providing the expressive prosodic model with information describing required target expression to synthesize.

With reference to the first and second aspects of the invention, in a fifth possible implementation of the present invention the at least one hardware processor is further configured to deliver the audio waveform to an audio device electrically connected to the at least one hardware processor. Optionally, the at least one hardware processor is further configured to store the audio waveform in a digital storage electrically connected to the at least one hardware processor in a digital format for storing audio information as known in the art. Storing the audio waveform allows playing the waveform on an audio device multiple times, in a plurality of occasions.

With reference to the first and second aspects of the invention, in a sixth possible implementation of the present invention each vector in each of the plurality of target prosody vector sequences comprises one or more prosodic parameters. Optionally, the one or more prosodic parameters are a syllabic prosody parameter. Optionally, the one or more prosodic parameters are a sub-phonemic prosody parameter. Using syllabic prosody parameters, sub-phonemic prosody parameters or a combination of syllabic and sub-phonemic prosody parameters may increase accuracy of prosody predicted by the expressive prosodic model. Optionally, the one or more prosodic parameters is selected from a group consisting of: a leading log-pitch value, a difference between a leading log-pitch value and a trailing log-pitch value, a syllable nucleus duration value, a breakpoint log-pitch value, a log-duration value, a delta-log-pitch to start value, a delta-log-pitch to end value, a breakpoint argument value normalized to a syllable nucleus duration value, a difference between a leading log-pitch value and a breakpoint log-pitch value, a leading log-pitch argument value normalized to a syllable nucleus duration value, a trailing log-pitch argument value normalized to a syllable nucleus duration value, a sub-phoneme normalized timing value, a sub-phoneme log-pitch difference value, an energy value, a maximal amplitude value and a minimal amplitude value.

With reference to the first and second aspects of the invention, in a seventh possible implementation of the present invention the at least one machine learning module comprises at least one neural network. Using a neural network for producing the expressive prosodic model may increase accuracy of prosody predicted by the expressive prosodic model.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DETAILED DESCRIPTION

Figure 1:
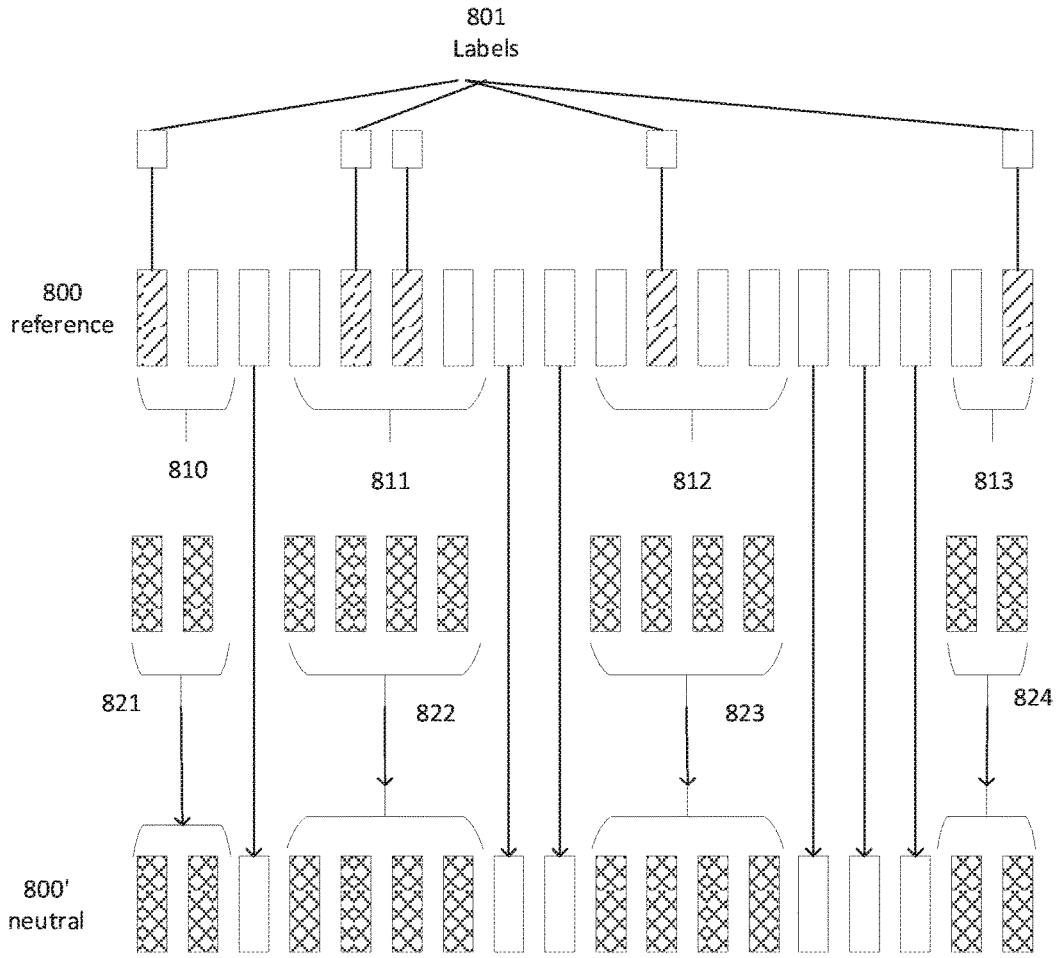
FIG. 1 is a schematic illustration of an exemplary prosody vector sequence, according to some embodiments of the present invention.

The present invention, in some embodiments thereof, relates to a system for speech synthesis and, more specifically, but not exclusively, to a system for speech synthesis from text.

As used henceforth, the term "model" means a trained machine learning module. In a deep neural network system, a model may comprise a plurality of weights assigned to a plurality of ties between a plurality of nodes of the deep neural network.

Henceforth the terms "expressive prosody model" and "expressive model" are used interchangeably, both meaning a model for predicting expressive prosody.

When an input text is fully or partially labeled with predetermined non-linguistic cues, some TTS systems apply, or impose, an expressive prosody model to the plurality of textual feature vectors produced from the input text according to the input labels. Examples of non-linguistic cues are emotions, for example anger and joy, word emphasis, and speaking styles, for example hyperactive articulation, and slow or fast articulation. Technologies for synthesizing speech based on a plurality of expressive (non-neutral) and neutral recordings of a single speaker are known in the art. However, in existing TTS systems producing an expressive prosody model may require a large amount of recordings of the same single speaker to extend an existing prosody model with realizations of some non-linguistic cues. Acquiring the large amount of recordings of the same single speaker may be cumbersome and costly. Sometimes acquiring the large amount of recordings is not possible, for example if the single speaker is no longer available for recordings.

Some known in the art methods for generating expressive speech comprise combining an expressive prosody model learned using recordings of one or more speakers with a prosody model of a target speaker. Some known in the art methods for generating an expressive prosody model from a limited amount of recordings comprise processing a plurality of expressive recordings of a plurality of utterances with a plurality of parallel neutral (non-expressive) recordings of the plurality of utterances. The plurality of parallel neutral recordings may be, but is not required to be, of the same speakers recorded in the plurality of expressive recordings, pronouncing exactly the same utterances. The plurality of expressive recordings may be, but is not limited to being, of a single speaker. Systems implementing such a method require parallel expressive and neutral recordings of the same utterances, which are not always available or feasible to record. A possible alternative to recording a plurality of parallel neutral recordings of a plurality of utterances equivalent to an existing plurality of expressive recordings of the same plurality of utterances from one or more speakers is to generate the plurality of neutral recordings with a neutral prosody model generated using known in the art machine learning methods such as Classification And Regression Tree (CART) learning, Hidden Markov Model (HMM) learning and Deep Neural Network (DNN) learning. However, machine learning of such a model may require thousands of neutral recordings of same speakers of the plurality of expressive recordings. Such neutral recordings may not be available or feasible to obtain.

Henceforth, the terms "prosody parameter vector" and "prosody vector" are used interchangeably.

A prosody parameter vector is a vector comprising one or more prosody parameters. A non-limiting list of examples of a prosody parameter includes a leading log-pitch value, a difference between a leading log-pitch value and a trailing log-pitch value, a syllable nucleus duration value, a breakpoint log-pitch value, a log-duration value, a delta-log-pitch to start value, a delta-log-pitch to end value, a breakpoint argument value normalized to a syllable nucleus duration value, a difference between a leading log-pitch value and a breakpoint log-pitch value, a leading log-pitch argument value normalized to a syllable nucleus duration value, a trailing log-pitch argument value normalized to a syllable nucleus duration value, a sub-phoneme normalized timing value, a sub-phoneme log-pitch difference value, an energy value, a maximal amplitude value and a minimal amplitude value.

We disclose hereby a method for automatic generation of a set of neutral prosody vector sequences using a set of expressive recordings and a set of textual features comprising a set of expression labels describing at least a part of the set of expressive recordings, called Local Statistics Manipulation (LSM) and using the set of parallel neutral prosody vector sequences to train an expressive prosody model. LSM is a method for modifying an input prosodic vector sequence by applying a linear combination of a plurality of statistical measures to each vector of a plurality of sub-sequences of the input prosody vector sequence, where each sub-sequence is selected according to a predefined vicinity of one of a plurality of selected time instances of vectors in the sequence.

The present invention, in some embodiments thereof, may be used to produce an expressive prosody model when only a limited amount of recordings exist, and in particular non-expressive recordings, insufficient for use with known in the art methods. The produced expressive model may be used within a TTS to generate expressive speech.

In addition, in some embodiments of the present invention, normalized prosody vector sequences are used when training the expressive prosody model, to reduce prosody prediction errors and speed up training. Normalizing a set of prosody vector sequences by a neutral model is a known in the art technique. The present invention, in some embodiments thereof, normalizes a plurality of target prosody vector sequences describing a plurality of at least partially expressive recordings with a plurality of parallel neutral prosody vector sequences produced using LSM. Next an expressive prosody model is trained using the plurality of normalized prosody vectors and the plurality of textual features.

The resulting expressive prosody model may be used to generate naturally sounding expressive speech, e.g. realizing requested non-linguistic cues. Computing parallel neutral prosody parameter sequences using LSM enables training high quality expressive prosody models based on a plurality of expressive recordings of a plurality of utterances, realized by a plurality of speakers when neither parallel neutral recordings of the plurality of utterances nor a large corpus of non-parallel neutral recordings is available for the plurality of speakers.

Some embodiments of the present invention use a plurality of expressive prosody vector sequences describing the plurality of expressive recordings. In such embodiments, a set of sub sequences is selected from the plurality of expressive prosody vectors, such that each sub sequence comprises at least some expressive vectors having a corresponding label in the set of expression labels, and optionally some neutral vectors having no such corresponding label. Next, LSM is performed on the set of subsequences to produce the parallel neutral prosody vectors. The parallel neutral vector sequences, combined with corresponding expressive or partially expressive sequences and textual feature vectors may serve for the expressive prosody model training.

Using the present invention, in some embodiments thereof, makes unnecessary the need to obtain parallel neutral and non-neutral recordings of the same utterances and thus facilitates producing an expressive prosody model and generating expressive speech for one or more speakers, when such parallel recordings do not exist and cannot be obtained.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing.

Computer readable program instructions described herein can be downloaded to respective computing/processing devices from a computer readable storage medium or to an external computer or external storage device via a network, for example, the Internet, a local area network, a wide area network and/or a wireless network.

The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Reference is now made to FIG. 1, showing a schematic illustration of an exemplary prosody vector sequence, according to some embodiments of the present invention. In such embodiments a prosody vector sequence comprises a sequence of prosody vectors 800. Some of the prosody vectors may be associated with one of a plurality of expression labels 801. Prosody vectors not associated with an expression label are considered neutral. A set of sub sequences 810, 811, 812 and 813 comprise each at least one prosody vector having an expression label, and some neutral vectors within a predefined vicinity of the at least one prosody vector having the expression label. Applying LSM to each vector in each sub-sequence of the set of sub-sequences, produces a set of respective neutral sub-sequences 821, 822, 823 and 824. A neutral sequence of prosody vectors 800' may be produced by replacing in sequence 800 subsequences 810, 811, 812 and 813 with neutral sub sequences 821, 822, 823 and 824 respectively.

Figure 2:
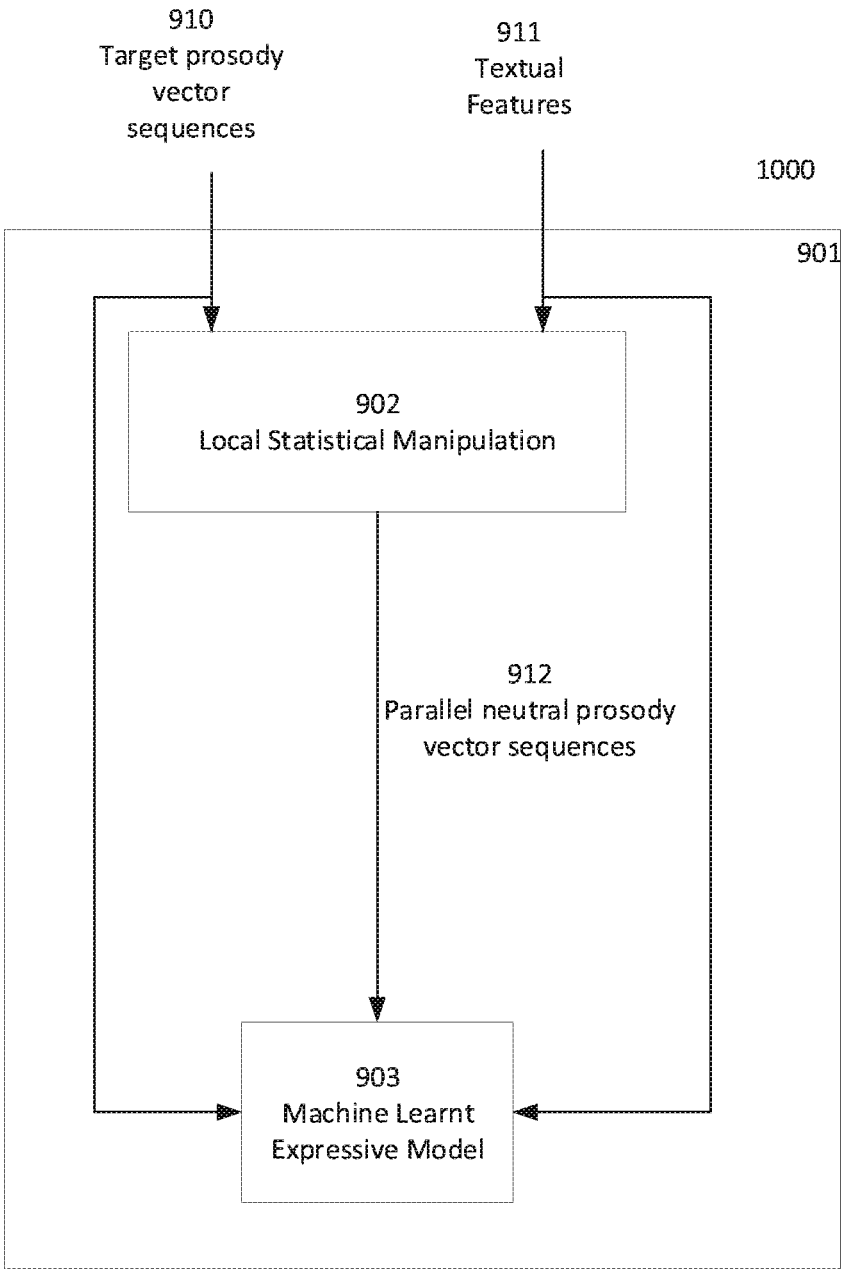
FIG. 2 is a schematic block diagram of an exemplary partial text to speech system for producing an expressive prosodic model, according to some embodiments of the present invention.

Reference is now made also to FIG. 2, showing a schematic block diagram of an exemplary partial text to speech system 1000 for producing an expressive prosodic model, according to some embodiments of the present invention. In such embodiments the system comprises at least one hardware processor 901, configured to execute at least one LSM module 902, connected to at least one machine learning module for producing a machine learnt expressive model 903. Optionally, a plurality of target prosody vector sequences 910 and a plurality of textual features 911 comprising a plurality of expression labels describing some of the vectors in the plurality of target prosody vector sequences are received by the LSM module. In these embodiments, the output of the LSM module is a plurality of parallel neutral prosody vector sequences 912, equivalent to the plurality of target prosody vector sequences. Optionally, the LSM module receives style control information and uses the style control information when producing the plurality of parallel neutral prosody vector sequences. The style control information may comprise one or more intensity control factors, for example weighting factors used for LSM evaluation. Optionally, the plurality of textual features 911 and plurality of neutral prosody vector sequences 912 produced by LSM module 902 are used to train the machine learning module. Optionally, the training process produces an expressive prosodic model. In some embodiments the machine learning module is a neural network. Optionally, regression learning as known in the art is used to train the machine learning module. Examples of types of neural network that can be trained using regression learning techniques are a deep neural network such as a recurrent neural network, a neural network comprising at least one gated recurrent unit, and long short term memory networks. Optionally, a Gaussian Mixture Model conversion is used by the machine learning module.

Figure 3:
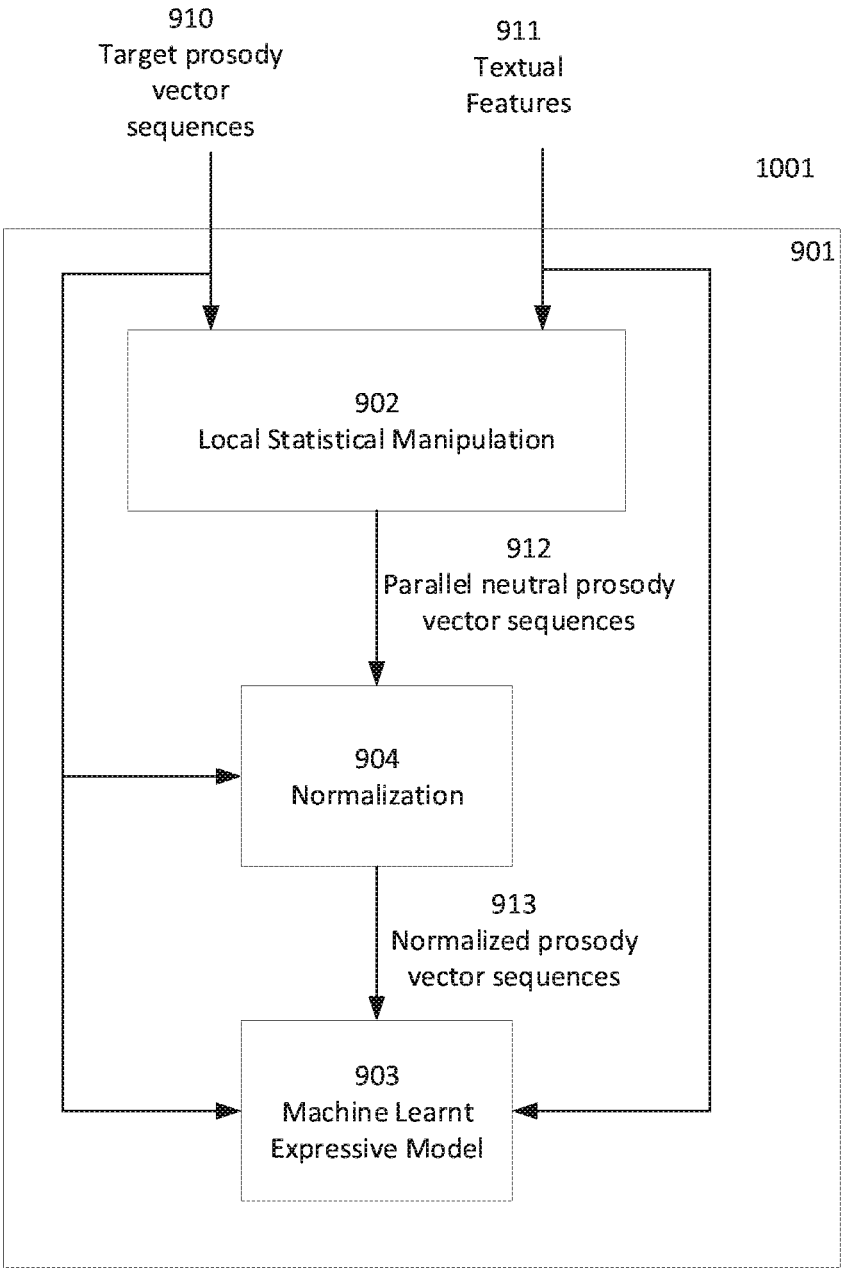
FIG. 3 is a schematic block diagram of another exemplary partial text to speech system for producing an expressive prosodic model using normalization, according to some embodiments of the present invention.

Reference is now made also to FIG. 3, showing a schematic block diagram of another exemplary partial text to speech system 1001 for producing an expressive prosodic model using normalization, according to some embodiments of the present invention. In such embodiments at least one hardware processor 901 is further configured to execute a normalization module 904 connected to LSM module 902 and connected to the at least one machine learning module for producing a machine learnt expressive model 903. Optionally, normalization module 904 normalizes the plurality of target prosody vector sequences 910 with the plurality of parallel neutral prosody vector sequences 912 produced by LSM module 902 to produce a plurality of normalized prosody vector sequences 913. Optionally, machine learnt expressive model 903 is trained using plurality of normalized prosody vector sequences 913 and the plurality of textual features 911. In some embodiments, the plurality of target prosody vector sequences 910 are additionally used for training machine learnt expressive model 903 to produce an expressive prosodic model.

To train systems 1000 or 1001 to produce an expressive prosodic model, in some embodiments of the present invention system 1000 or system 1001 implements the following optional method.

Figure 4:
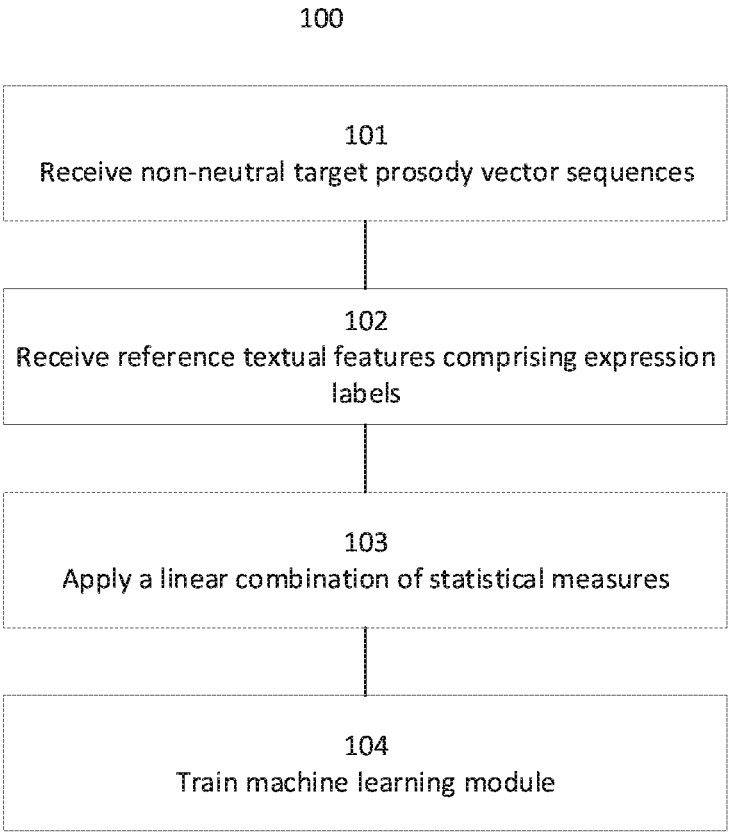
FIG. 4 is a flowchart schematically representing an optional flow of operations for producing an expressive model, according to some embodiments of the present invention.
Figure 5:
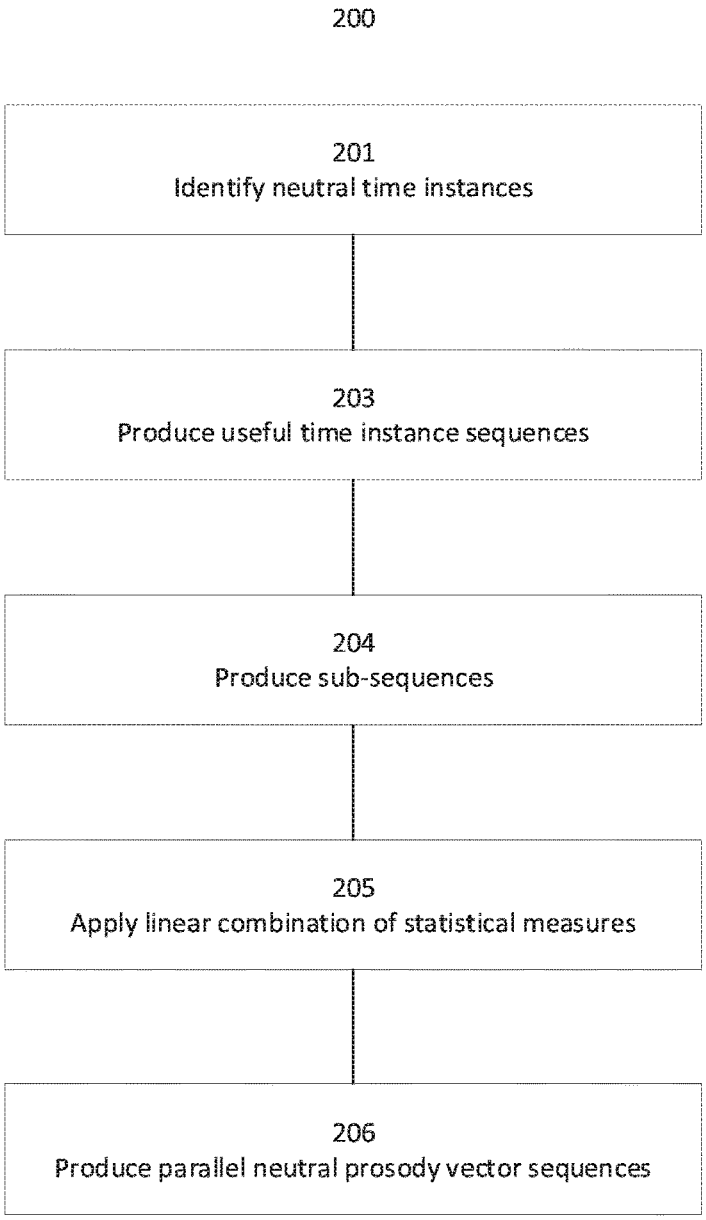
FIG. 5 is a flowchart schematically representing an optional flow of operations for applying a linear combination of statistical measures, according to some embodiments of the present invention.

Reference is now made also to FIG. 4, showing a flowchart schematically representing an optional flow of operations 100 for producing an expressive model, according to some embodiments of the present invention. In such embodiments, the at least one hardware processor receives in 101 a plurality of non-neutral target prosody vector sequences describing a plurality of reference voice samples of one or more reference speakers. Optionally, each vector in each vector sequence in the plurality of target prosody vector sequences comprises a plurality of prosody parameters, describing the reference voice sample at a certain time instance associated with the vector. Some of the vectors may be syllabic, each syllabic vector comprising a plurality of prosody parameters describing a syllable from one of the plurality of reference voice samples. Some of the vectors may be sub-phonemic, each sub-phonemic vector comprising a plurality of prosody parameters describing duration in the plurality of reference voice samples shorter than a complete syllable. In 102, the at least one hardware processor optionally receives a plurality of reference textual features describing the plurality of target voice samples. The plurality of reference textural features optionally comprises a plurality of expression labels. Each expression label of the plurality of expression labels may have a time instance corresponding to at least one time instance of one of the vectors in the plurality of target prosody vector sequences. A plurality of time instances optionally comprises all the time instances of all the vectors in the plurality of reference prosody vector sequences. A plurality of non-neutral time instances optionally comprises all the time instances of all the expression labels in the plurality of expression labels. The plurality of non-neutral time instances is optionally a subset of the plurality of time instances. Optionally, the plurality of time instances comprises a subset of neutral time instances not in the plurality of non-neutral time instances, and vectors associated with one of the subset of neutral time instances is considered having a neutral label and neutral prosody. In 103, the at least one hardware processor optionally applies to a plurality of sub-sequences of the plurality of target prosody vector sequences a linear combination of a plurality of statistical measures computed using the plurality of sub-sequences. Optionally, the plurality of sub-sequences is selected according to an identified proximity test applied to the plurality of neutral time instances identified in the plurality of time instances. Reference is now made also to FIG. 5, showing a flowchart schematically representing an optional flow of operations 200 for applying a linear combination of statistical measures, according to some embodiments of the present invention.

Figure 6:
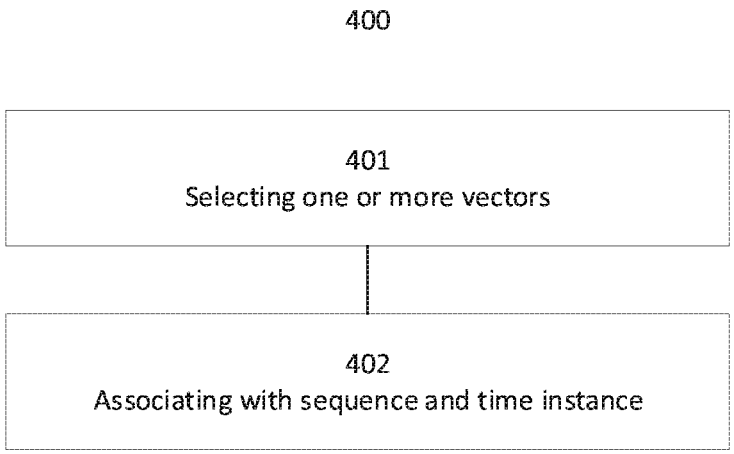
FIG. 6 is a flowchart schematically representing an optional flow of operations for producing sub-sequences, according to some embodiments of the present invention.

In such embodiments, In 201 the at least one hardware processor optionally identifies a plurality of neutral time instances, such that the plurality of expression labels does not have a label associated with any of the plurality of neutral time instances and each of the neutral time instances is in an identified vicinity of at least one of the plurality of non-neutral time instances. Optionally, the plurality of expression labels has a neutral label associated with some of the plurality of neutral time instances. In 203, the at least one hardware processor optionally produces a plurality of useful time instance sequences to use as input for producing a plurality of vector sub-sequences to which a linear combination of a plurality of statistical measures may be applied. The plurality of useful time instance sequences may be produced by augmenting each of the neutral time instances in the plurality of neutral time instances with at least some of the plurality of non-neutral time instances that are in the identified vicinity of the neutral time instance. Optionally, the at least one hardware processor produces in 204 a plurality of vector sub-sequences, by producing a sub-sequence for each useful time instance sequence in the plurality of useful time instance sequences. Reference is now made also to FIG. 6, showing a flowchart schematically representing an optional flow of operations 400 for a producing a sub-sequence associated with a useful time instance sequence, according to some embodiments of the present invention.

In such embodiments, the at least one hardware processor selects in 401 from one vector sequence of the plurality of reference prosody vector sequences one or more vectors, each associated with a time instance in the useful time instance sequence. Optionally, in 402 the at least one hardware processor associates the sub-sequence with the at least some non-neutral time instance in the useful time instance sequence and with the vector sequence from which the one or more vectors were selected. In some embodiments, only stressed syllable prosody parameters are used when producing the plurality of sub-sequences to be used when applying LSM.

Figure 7:
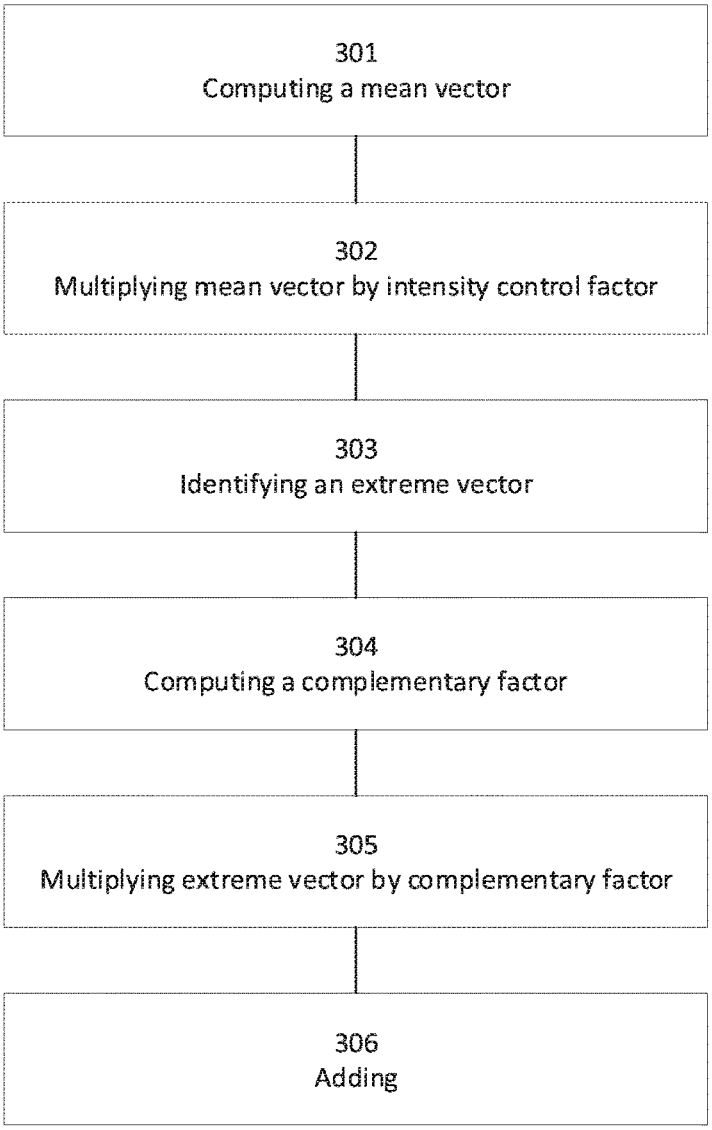
FIG. 7 is a flowchart schematically representing an optional flow of operations for computing a linear combination of statistical measures, according to some embodiments of the present invention.

Reference is now made again to FIG. 5. In 205, the at least one hardware processor optionally applies to each vector in each of the plurality of sub-sequences a linear combination of a plurality of statistical measures computed using the plurality of sub-sequences, to produce a plurality of approximate neutral prosody vectors associated with the at least some non-neutral time instances of the plurality of sub-sequences. Reference is now made also to FIG. 7, showing a flowchart schematically representing an optional flow of operations 300 for computing a linear combination of statistical measures, according to some embodiments of the present invention.

In such embodiments, for each sub-sequence the at least one hardware processor computes in 301 a mean vector by computing the mean of all vectors in the sub-sequence, and multiplies the mean vector in 302 by an intensity control factor to produce a first term. Optionally, component-wise multiplication is used to multiply the mean vector by an intensity control factor. The intensity control factor may be a value normalized to the range of 0 to 1, for example an energy value normalized to the range of 0 to 1. In 303 the at least one hardware processor optionally identifies an extreme vector. The extreme vector may be a maximum vector of all vectors in the sub-sequence. Optionally, the extreme vector is a minimum vector of all vectors in the sub-sequence. In 304 the at least one hardware processor optionally computes a complementary intensity factor by subtracting the intensity control factor from 1, then optionally multiplying in 305 the extreme vector by the complementary intensity factor to produce a second term. Optionally, in 306 the at least one hardware processor adds the second term to the first term to produce the linear combination of statistical measures.

Optionally, the plurality of statistical measures comprises a plurality of vectors produced by computing a quantile function using the plurality of sub-sequences at a predefined plurality of points. In one example, the plurality of statistical measures comprises a 0.05-quantile, a 0.5 quantile and a 0.95-quantile. The predefine plurality of points may consist of other points. The linear combination of statistical measures may be a linear combination of the plurality of computed quantile functions, each multiplied by one of a plurality of intensity control factors.

Reference is now made again to FIG. 5. In 206, the at least one hardware processor optionally produces the plurality of parallel neutral prosody vector sequences by selecting some vectors from the plurality of approximate neutral prosody vectors and some other vectors from the plurality of target prosody vector sequences. Optionally, for each vector in the plurality of target prosody vector sequences, where the vector is associated with a time instance having an expression label in the plurality of expression labels the at least one hardware processor optionally selects a vector of the plurality of approximate neutral prosody vectors associated with the time instance and the target sequence of the vector. Otherwise, for each vector not having an expression label, the at least one hardware processor select the vector itself. Thus the plurality of parallel neutral prosody vector sequences are produced using the neutral prosody vectors from the plurality of target prosody vector sequences, replacing each non-neutral vector with a corresponding approximate neutral prosody vector.

Reference is now made again to FIG. 4. Now the at least one hardware processor optionally trains in 104 at least one machine learning module using the generated plurality of parallel neutral prosody vector sequences, the plurality of target prosody vector sequences and the plurality of textual features, to produce an expressive prosodic model. In some embodiments comprising a normalization module, before training the at least one machine learning module the target prosody vector sequences are normalized by the normalization module using the parallel neutral prosody vector sequences to produce a plurality of normalized prosody vector sequences, and the at least one machine learning module is trained using the plurality of normalized prosody vector sequences alternately to using the plurality or parallel neutral prosody vector sequences. Training the at least one machine learning module may be using the plurality of normalized prosody vector sequences in addition to using the plurality of target prosody vector sequences or alternately to using the plurality of target prosody vector sequences.

Optionally, the machine learning model processing is repeated iteratively. Optionally, the expressive prosodic model is output, for use in one or more TTS systems.

In some embodiments of the present invention, the expressive prosodic model produced using LSM is used within a TTS to generate expressive speech from an input plurality of textual feature vectors comprising a plurality of expression (or style) labels. A textual feature vector comprises one or more phonetic transcriptions and prosody information. Optionally the plurality of textual feature vectors comprises a plurality of text prosody vector sequences describing the text. The plurality of text prosody vector sequences may describe neutral prosody. Optionally, the plurality of textual feature vectors is generated from an input text, using known in the art methods and techniques.

Figure 8:
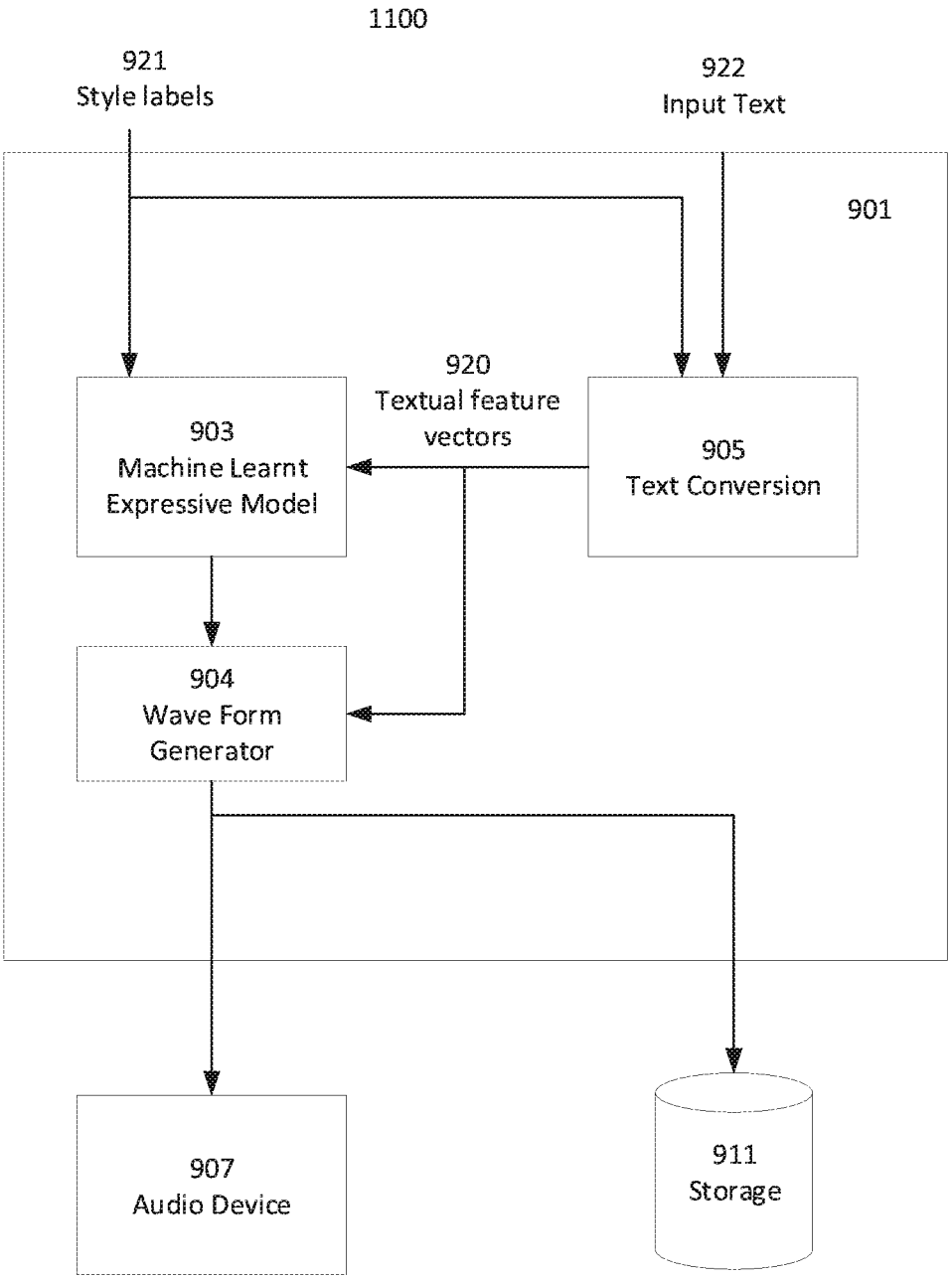
FIG. 8 is a schematic block diagram of an exemplary system for generating expressive synthesized speech, according to some embodiments of the present invention.

Reference is now made to FIG. 8, showing a schematic block diagram of a partial exemplary system 1100 for generating expressive synthesized speech, according to some embodiments of the present invention. In some embodiments of the present invention an expressive model 903 is produced in a different TTS system and loaded to at least one software module of system 1100. In some other embodiments, the expressive model 903 is produced by system 1100 as in system 1000 or system 1001, and the at least one hardware processor 901 further executes at least one text conversion module 905. The at least one text conversion module optionally processes input text 922 to produce a plurality of textual feature vectors 920 representing the input text. Optionally, the at least one software module is connected to the text conversion module for applying a previously produced expressive model 903 to the plurality of textual feature vectors and the plurality of expression labels, to produce a plurality of expressive prosody vectors. Optionally, the at least one software module comprises at least one neural network. The at least one software module is optionally connected to a waveform generator 904 for producing an audio waveform from the plurality of textual feature vectors and the plurality of expressive prosody vectors. An audio device 907 is optionally electrically connected to the at least one hardware processor. The waveform generator may deliver the audio waveform to the audio device. Optionally, at least one hardware processor 901 is connected to at least one digital storage 911. At least one hardware processor 901 may store the audio waveform in at least one digital storage 911 in a digital format for storing audio information as known in the art. Some examples of known in the art digital formats for storing audio information are Microsoft Windows Media Audio formal (WMA), Free Lossless Audio Codec (FLAC) and Moving Picture Experts Group layer 3 audio format (MPEG3).

To produce a waveform, in some embodiments of the present invention system 1100 implements the following optional method.

Figure 9:
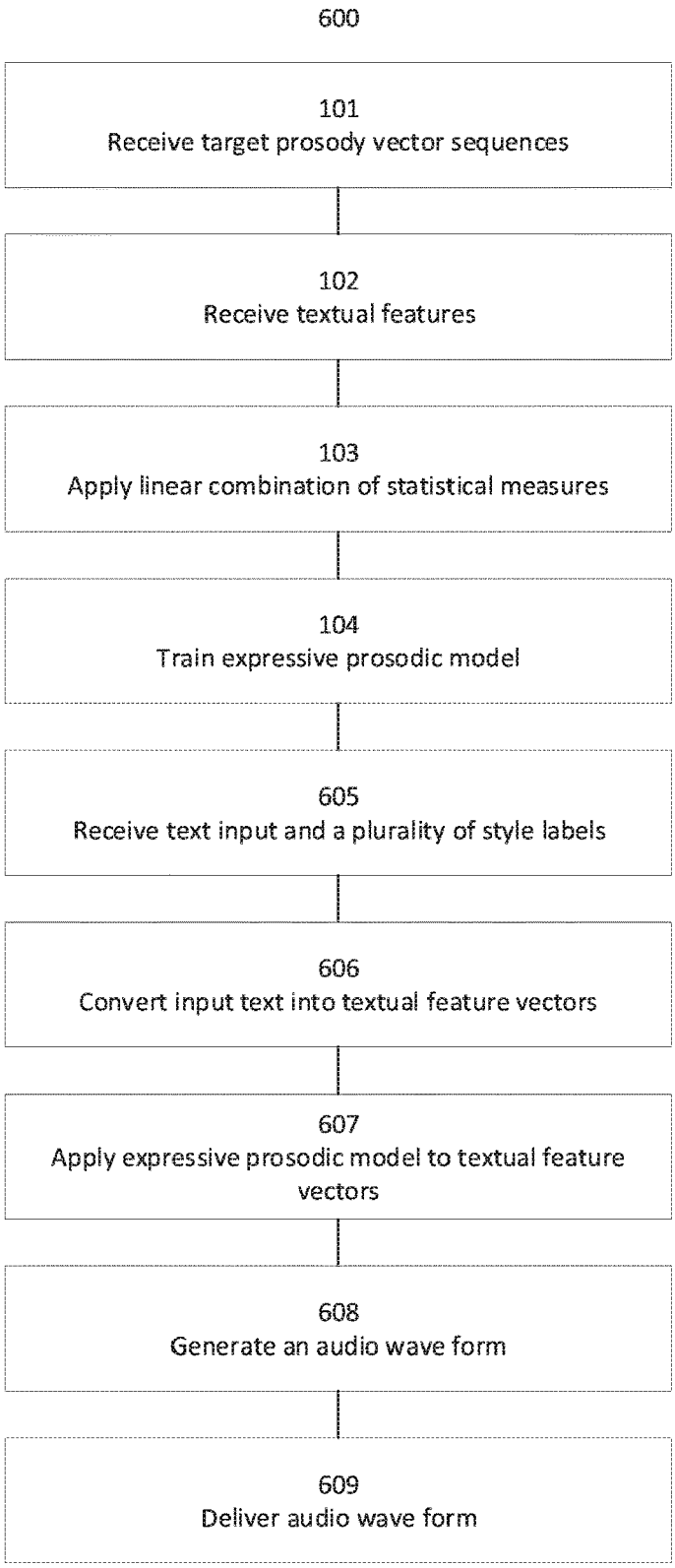
FIG. 9 is a flowchart schematically representing an optional flow of operations for generating expressive synthesized speech, according to some embodiments of the present invention.

Reference is now made to FIG. 9, showing a flowchart schematically representing an optional flow of operations 600 for generating expressive synthesized speech, according to some embodiments of the present invention. In such embodiments, the at least one hardware processor accesses an expressive prosodic module. Optionally, the expressive prosodic module is produced by another TTS system. Optionally, the at least one hardware processor produces the expressive prosodic model by receiving in 101 a plurality of target prosody vector sequences and in 102 receiving a plurality of reference textual features comprising a plurality of expression labels at least partially describing the plurality of target prosody vector sequences, in 103 applying LSM to produce a plurality of parallel neutral prosody vector sequences and in 104 producing an expressive prosodic model by training at least one machine learning using the plurality of parallel neutral prosody vector sequences and the plurality of textual features. Next, the at least one hardware processor optionally processes an input text using the expressive prosodic module to produce an expressive audio waveform. In some embodiments, in 605, the at least one hardware processor receives a text input and a plurality of style labels associated with at least part of the input text. Optionally, in 606 the at least one hardware processor converts the input text to a plurality of textual feature vectors using conversion methods as known in the art. In 607, the at least one hardware processor optionally applies the generated expressive prosodic model to the plurality of textual features and the plurality of expression (style) labels to produce a plurality of expressive prosody vectors. In 608, the plurality of expressive prosody vectors and the plurality of textual features may be used by the at least one hardware processor to generate an audio waveform, optionally delivered in 609 to an audio device electrically connected to the at least one hardware processor and alternately or in addition optionally stored in a digital storage connected to the at least one hardware processor.

In some embodiments, the plurality of textual features comprises only syllabic textual features and is used for generation of a plurality of expressive syllable-level prosody vector sequences. Optionally, another plurality of textual features comprising sub-phonemic textual features is used to generate a plurality neutral sub-phonemic prosody parameter sequences which is then combined with the plurality of expressive syllable-level prosody vector sequences to produce a combined set of prosody vector sequences, used for audio waveform generation.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

It is expected that during the life of a patent maturing from this application many relevant prosody parameters, linear combinations of statistical measures and digital audio formats will be developed and the scope of the terms "prosody parameters", "linear combinations of statistical measures" and "digital audio formats" are intended to include all such new technologies a priori.

As used herein the term "about" refers to ±10%.

The terms "comprises", "comprising", "includes", "including", "having" and their conjugates mean "including but not limited to". This term encompasses the terms "consisting of" and "consisting essentially of".

The phrase "consisting essentially of" means that the composition or method may include additional ingredients and/or steps, but only if the additional ingredients and/or steps do not materially alter the basic and novel characteristics of the claimed composition or method.

As used herein, the singular form "a", "an" and "the" include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A method for producing speech, comprising:

accessing an expressive prosody model, wherein said expressive prosody model is generated by:

receiving a plurality of non-neutral target prosody vector sequences describing a plurality of reference voice samples of one or more reference speakers, each prosody vector associated with one of a plurality of time instances;

receiving a plurality of reference textual features comprising a plurality of expression labels describing said plurality of reference voice samples, each label having a time instance selected from a plurality of non-neutral time instances selected from said plurality of time instances;

producing a plurality of parallel neutral prosody vector sequences equivalent to said plurality of non-neutral target prosody vector sequences at said plurality of non-neutral time instances by applying a linear combination of a plurality of statistical measures computed using a plurality of sub-sequences of said plurality of target prosody vector sequences to said plurality of sub-sequences, where said plurality of sub-sequences is selected according to an identified proximity test applied to a plurality of neutral time instances identified in said plurality of time instances; and training at least one machine learning module using said plurality of non-neutral target prosody vector sequences and said plurality of parallel neutral prosody vector sequences to produce an expressive prosody model; and using said expressive prosody model within a Text To Speech (TTS) system to produce an audio waveform from an input text.

2. The method of claim 1, wherein said applying a linear combination of a plurality of statistical measures comprises:

identifying a plurality of neutral time instances where said plurality of expression labels has a neutral label or no label, each of said plurality of neutral time instances being in an identified vicinity of at least one of said plurality of non-neutral time instances;

producing a plurality of useful time instance sequences by augmenting each neutral time instance in said plurality of neutral time instances with at least some of said plurality of non-neutral time instances in said identified vicinity of said neutral time instance;

producing said plurality of sub-sequences by producing for each time instance sequence of said useful time instance sequences a sub-sequence, comprising:

selecting from one vector sequence of said plurality of target prosody vector sequences one or more vectors, each associated with a time instance in said time instance sequence; and associating said sub-sequence with said vector sequence and said at least some non-neutral time instance of said time instance sequence;

applying a linear combination of a plurality of statistical measures computed using said plurality of sub-sequences to each of said plurality of sub-sequences to produce a plurality of approximate neutral prosody vectors associated with said at least some non-neutral time instances of said sub-sequences; and producing said plurality of parallel neutral prosody vector sequences by for each vector in said plurality of target prosody vector sequences, where said vector is associated with a time instance having an expression label in said plurality of expression labels, selecting one of said plurality of approximate neutral prosody vectors associated with said time instance and said vector's target sequence, and otherwise selecting said vector.

3. The method of claim 2, wherein said linear combination of a plurality of statistical measures applied to each sub-sequence comprises:

computing a mean vector of all vectors in said sub-sequence;

multiplying said mean vector by an intensity control factor using component-wise multiplication to produce a first term;

identifying an extreme vector by identifying a maximum vector or a minimum vector of all vectors in said sub-sequence;

computing a complementary factor by subtracting said intensity control factor from 1;

multiplying said extreme vector by said complementary factor using component-wise multiplication to produce a second term; and adding said first term to said second term.

4. The method of claim 2, wherein said plurality of statistical measures comprises a plurality of vectors produced by computing a quantile function using said plurality of sub-sequences at a predefined plurality of points.

5. The method of claim 4, wherein said predefined plurality of points consists of 0.05, 0.5, and 0.95.

6. The method of claim 1, further comprising:

normalizing said plurality of non-neutral target prosody vector sequences with said parallel neutral prosody vector sequences to produce a plurality of normalized non-neutral prosody vector sequences; and training said at least one machine learning module using said plurality of normalized non-neutral target prosody vector sequences and said plurality of textual features to produce said expressive prosody model.

7. The method of claim 1, wherein said expressive prosody model is further generated by:

outputting said expressive prosody model to a digital storage in a format that can be used to initialize another machine learning module.

8. The method of claim 1, wherein said audio waveform is produced for said input text using said expressive prosody model by:

receiving said input text and a plurality of style labels associated with at least part of said input text;

converting said input text into a plurality of textual feature vectors using conversion methods;

applying said expressive prosody model to said plurality of textual feature vectors and said plurality of style labels to produce a plurality of expressive prosody vectors; and generating an audio waveform from said plurality of textual feature vectors and said plurality of expressive prosody vectors.

9. The method of claim 1, further comprising:

delivering said audio waveform to an audio device electrically connected to said at least one hardware processor or storing said audio waveform in a digital storage connected to said at least one hardware processor in a digital format for storing audio information.

10. The method of claim 1, wherein each vector in each of said plurality of target prosody vector sequences comprises one or more prosody parameters.

11. The method of claim 10, wherein said one or more prosody parameters is a syllabic prosody parameter.

12. The method of claim 10, wherein said one or more prosody parameters is a sub-phonemic prosody parameter.

13. The method of claim 10, wherein said one or more prosody parameters is selected from a group consisting of: a leading log-pitch value, a difference between a leading log-pitch value and a trailing log-pitch value, a syllable nucleus duration value, a breakpoint log-pitch value, a log-duration value, a delta-log-pitch to start value, a delta-log-pitch to end value, a breakpoint argument value normalized to a syllable nucleus duration value, a difference between a leading log-pitch value and a breakpoint log-pitch value, a leading log-pitch argument value normalized to a syllable nucleus duration value, a trailing log-pitch argument value normalized to a syllable nucleus duration value, a sub-phoneme normalized timing value, a sub-phoneme log-pitch difference value, an energy value, a maximal amplitude value and a minimal amplitude value.

14. The method of claim 1, wherein said at least one machine learning module comprises at least one neural network.

15. A system for producing an expressive prosody model, comprising at least one hardware processor configured to:

receive a plurality of non-neutral target prosody vector sequences describing a plurality of reference voice samples of one or more reference speakers, each prosody vector associated with one of a plurality of time instances;

receive a plurality of reference textual features comprising a plurality of expression labels describing said plurality of reference voice samples, each label having a time instance selected from a plurality of non-neutral time instances selected from said plurality of time instances;

produce a plurality of parallel neutral prosody vector sequences equivalent to said plurality of non-neutral target prosody vector sequences at said plurality of non-neutral time instances by applying a linear combination of a plurality of statistical measures computed using a plurality of sub-sequences of said plurality of target prosody vector sequences to said plurality of sub-sequences, where said plurality of sub-sequences is selected according to an identified proximity test applied to a plurality of neutral time instances identified in said plurality of time instances; and train at least one machine learning module using said plurality of non-neutral target prosody vector sequences and said plurality of parallel neutral prosody vector sequences to produce an expressive prosody model.

16. A system for producing speech, comprising at least one hardware processor configured to:

access an expressive prosody model, wherein said expressive prosody model is generated by:

receiving a plurality of non-neutral target prosody vector sequences describing a plurality of reference voice samples of one or more reference speakers, each prosody vector associated with one of a plurality of time instances;

receiving a plurality of reference textual features comprising a plurality of expression labels describing said plurality of reference voice samples, each label having a time instance selected from a plurality of non-neutral time instances selected from said plurality of time instances;

producing a plurality of parallel neutral prosody vector sequences equivalent to said plurality of non-neutral target prosody vector sequences at said plurality of non-neutral time instances by applying a linear combination of a plurality of statistical measures computed using a plurality of sub-sequences of said plurality of target prosody vector sequences to said plurality of sub-sequences, where said plurality of sub-sequences is selected according to an identified proximity test applied to a plurality of neutral time instances identified in said plurality of time instances; and training at least one machine learning module using said plurality of non-neutral target prosody vector sequences and said plurality of parallel neutral prosody vector sequences to produce an expressive prosody model; and using said expressive prosody model to produce an audio waveform from an input text.

17. The system of claim 16, wherein said at least one hardware processor is further configured to deliver said audio waveform to an audio device electrically connected to said at least one hardware processor.

18. The system of claim 16, wherein said at least one hardware processor is further configured to store said audio waveform in a digital storage electrically connected to said at least one hardware processor in a digital format for storing audio information.

19. The system of claim 16, wherein said at least one machine learning module comprises at least one neural network.

* * * * *